United States Patent [19]

Thompson

[11] Patent Number: 5,036,599

[45] Date of Patent: Aug. 6, 1991

[54] METHOD OF CONCENTRATING SLURRIED KAOLIN

[75] Inventor: William E. Thompson, Macon, Ga.

[73] Assignee: Georgia Kaolin Company, Inc., Union, N.J.

[21] Appl. No.: 290,135

[22] Filed: Dec. 27, 1988

[51] Int. Cl.[5] ..... F26B 7/00

[52] U.S. Cl. ..... 34/5; 159/47.1; 34/17

[58] Field of Search ..... 34/17, 5, 9, 60, 134, 34/133; 159/47.1, 17.1, 23, 2.1

[56] References Cited

U.S. PATENT DOCUMENTS

| | | | |
|---|---|---|---|
| 3,486,740 | 12/1969 | Christian | 34/134 |
| 4,642,904 | 2/1987 | Smith, Jr. | 34/9 |
| 4,687,546 | 8/1987 | Willis | 159/47.1 |

FOREIGN PATENT DOCUMENTS

| | | |
|---|---|---|
| 506512 | 3/1953 | Belgium . |
| 0045912 | 2/1982 | European Pat. Off. . |
| 3629954 | 3/1988 | Fed. Rep. of Germany . |
| 2252989 | 6/1975 | France . |
| 2368669 | 5/1978 | France . |

*Primary Examiner*—Henry A. Bennet

*Attorney, Agent, or Firm*—Klauber & Jackson

[57] ABSTRACT

An aqueous beneficiated clay slurry is concentrated from a lower solids content to a higher solids content by evaporating water therefrom by passing the aqueous clay slurry through one or more non-contact evaporative heat exchangers in indirect heat exchange relationship with a hot drying fluid. The driving fluid, that is the heating medium which is passed in indirect heat exchange relationship with the aqueous clay slurry to initiate the evaporation process, comprises a hot liquid, preferably a moderate temperature hot liquid such as hot water having a temperature ranging from about 120° F. to about 200° F.

19 Claims, 2 Drawing Sheets

METHOD OF CONCENTRATING SLURRIED KAOLIN

BACKGROUND OF THE INVENTION

The present invention relates generally to the processing of clay and, more particularly, to a method for concentrating a beneficiated aqueous kaolin clay slurry by evaporating water therefrom using indirect heat exchange.

Kaolin clay has many known applications in industry, including use as a filler in paper making, a coating for paper, and a pigment in paint. However, crude kaolin clay typically contains various impurities which cause discoloration. Additionally, crude kaolin clay by various well-known commercial processes which increase the brightness of the kaolin by removing discoloration impurities and decrease the abrasiveness by reducing the particle size of the kaolin particles.

In general, such processes for beneficiating crude kaolin clay require that the clay be processed as a low solids slurry. Therefore, it is necessary to add substantial amounts of water to the dry crude kaolin clay to form a clay suspension or slurry having a low solids content, typically in the range of 15% to 40% by weight. However, for commercial applications, the beneficiated clay slurry must have a much higher solids content. Typically beneficiated kaolin clays are shipped commercially for use in paper making, paper coating and paint making as a high solids slurry having a solids content in the range of 65% to 75% by weight. Therefore, most of the water added to the dry kaolin clay must be removed in order to concentrate the clay solids.

In a typical conventional process for dewatering a beneficiated clay slurry, the low-solids slurry is typically first passed to a vacuum or press type filter wherein a limited portion of the water is removed from the slurry. Typically, the filter cake from the filter would have a solids content of about 50% to 60% by weight. Thus, the slurry would still comprise about 40% to 50% water. Further dewatering on a vacuum or press type filter is impractical due to the fine particle size of the solids in the beneficiated clay slurry. Typically, to further dewater the beneficiated clay slurry to a commercially acceptable solids content, at least a portion of the partially dewatered slurry is passed through a spray dryer or other direct contact-type evaporator such as a gas-fired kiln, wherein the clay slurry is contacted with a drying medium having a temperature of 1000° F. or more, such as hot air or hot flue gas typically generated from the combustion of natural gas. Although all of the clay slurry may be passed through the spray dryer for drying, it is customary to pass only a portion of the clay slurry through the spray dryer and then to re-mix the thoroughly dried clay slurry from the spray dryer with the remaining portion of partially dewatered slurry in a high shear mixer to produce a product clay slurry having a solids content of 65% to 75%.

A problem encountered in concentrating clay slurries in spray dryers or other direct contact-type evaporators is the formation of agglomerates of dried clay during direct contact evaporation. Therefore, it is often necessary to pass the product clay slurry through a pulverizer in order to breakup such agglomerates prior to shipping the slurry. Additionally, when kaolin clays are dried in direct contact-type evaporators such as spray dryers at these high temperatures, the brightness of the clay particles deteriorate slightly. Further, spray drying is a relatively inefficient process and considerable energy is consumed in the spray drying process in order to evaporate the water in the clay slurry.

One very effective method of concentrating kaolin clay slurries by evaporating water therefrom in such a manner as to avoid the formation of agglomerates and the deterioration of clay brightness attendant to spray drying is disclosed in commonly assigned U.S. Pat. No. 4,687,546 of Willis. As disclosed therein, an aqueous beneficiated clay slurry is concentrated by evaporating water therefrom by passing the aqueous clay slurry through one or more non-contact evaporative heat exchangers in indirect heat exchange relationship with a heating vapor wherein the heating vapor comprises water vapor previously evaporated from the aqueous clay slurry. In this manner, an energy efficient process is provided for concentrating a beneficiated aqueous clay slurry in that the present invention makes use of the heat normally wasted when the flue gas from the spray dryer together with the water vapor evaporated from the clay during the spray drying process is vented to the atmosphere. Further, by using indirect heat exchange between the aqueous clay slurry and the heating vapor as a means of evaporating water vapor from the clay slurry, the clay and the hot drying vapor do not contact, thereby avoiding, formation of agglomerates typically encountered in the direct contact evaporators.

In one embodiment disclosed in U.S. Pat. No. 4,687,546, a continuous stream of clay slurry to be concentrated is passed through a single non-contact type evaporative heat exchanger in indirect heat exchange relationship with recycled water vapor. That is, water vapor evaporated from the clay slurry in the heat exchanger is collected, compressed to increase its temperature, and recycled to the heat exchanger as the heating vapor to evaporate water from the incoming clay slurry.

In another embodiment disclosed in U.S. Pat. No. 4,687,547, a continuous stream of the clay slurry to be concentrated is passed through a plurality of non-contact evaporative heat exchangers in series flow from the upstream-most of the heat exchangers to the downstream-most of the heat exchangers in indirect heat exchange relationship with a heating vapor. The heating vapor in each of the evaporative heat exchangers comprises the water vapor evaporated from the aqueous clay slurry in the adjacent downstream evaporative heat exchanger, except in the downstream-most of the evaporative heat exchangers wherein the heating vapor is supplied from an independent source. The aqueous clay slurry exiting the downstream-most evaporative heat exchanger may be passed through a flash tank wherein additional water is removed from the aqueous clay slurry thereby further concentrating the solids in the aqueous clay slurry. Additionally, it is disclosed that the aqueous clay slurry to be concentrated may be preheated by passing the aqueous clay slurry in indirect heat exchange relationship with the water vapor evaporated from the aqueous clay slurry in the upstream-most evaporative heat exchanger prior to passing the aqueous clay slurry to the upstream-most evaporative heat exchanger.

However, in some clay processing operations a heating vapor, such as steam, may not be readily available for initiating the evaporation process in the vapor driven indirect evaporative drying process as disclosed in U.S. Pat. No. 4,687,546, whether it be a single-effect or multi-effect embodiment of the process. Rather, hot liquid, typically water having a temperature in the range of about 130° F. to about 180° F., may be the only heating medium readily available. Therefore, it would desirable to be able to utilize such moderate temperature hot liquid as the driving fluid, i.e., heating medium, to concentrate solids in an aqueous clay slurry by passing the aqueous clay slurry in indirect, non-contact heat exchange relationship with the hot liquid to evaporate water from the aqueous clay slurry.

Accordingly, it is the general object of the present invention to provide a method for concentrating a beneficiated aqueous clay slurry in an energy efficient manner by evaporating water from the clay slurry using hot liquid as the heating medium.

It is a further object of the present invention to provide a method for concentrating the beneficiated aqueous clay kaolin slurry by evaporation without the formation of agglomerates or the deterioration of clay brightness during the drying process.

SUMMARY OF THE INVENTION

In accordance with the present invention, an aqueous beneficiated clay slurry is concentrated from a lower solids content to a higher solids content by evaporating water therefrom by passing the aqueous clay slurry through one or more non-contact evaporative heat exchangers in indirect heat exchange relationship with a hot driving fluid. The driving fluid, that is the heating medium which is passed in indirect heat exchange relationship with the aqueous clay slurry to initiate the evaporation process, comprises a hot liquid, preferably a moderate temperature hot liquid such as hot water having a temperature ranging from about 120° F. to about 200° F.

In one embodiment of the present invention, a stream of clay slurry to be concentrated is passed, either in continuous flow or batch flow, through a single non-contact type evaporative heat exchanger in indirect heat exchange relationship with a continuous stream of hot water. Hot water having a temperature in the range of about 130° F. to about 150° F. may be provided by heating process water with waste heat in the exhaust gases from spray dryers or calciners. The hot water used as the heating fluid may also comprise, at least in part, condensed water vapor evaporated from the clay slurry in the heat exchanger. That is, water vapor evaporated from the clay slurry in the heat exchanger is collected, condensed to a liquid, heated to the desired temperature, and recycled to the heat exchanger as the heating fluid to evaporate water from the incoming clay slurry.

In another embodiment of the present invention, a continuous stream of the clay slurry to be concentrated is passed through a plurality of non-contact evaporative heat exchangers in series flow from the upstream-most with respect to clay slurry flow of the heat exchangers to the downstream-most with respect to clay slurry flow of the heat exchangers in indirect heat exchange relationship with a heating medium. The heating medium in each of the evaporative heat exchangers comprises the water vapor evaporated from the aqueous clay slurry in the adjacent downstream evaporative heat exchanger, except in the downstream-most of the evaporative heat exchangers wherein the heating medium is hot water, preferably hot water having a temperature of at least about 180° F. Additionally, it is preferred that the aqueous clay slurry to be concentrated be preheated by passing the aqueous clay slurry in indirect heat exchange relationship with the cooled heating medium from the downstream-most evaporative heat exchanger prior to passing the aqueous clay slurry to the upstream-most evaporative heat exchanger.

DESCRIPTION OF THE PREFERRED EMBODIMENT

In order to be useful in paper filling, paper coating and paint making, naturally occurring crude kaolin clays must generally be processed to upgrade the clay in brightness and to reduce abrasiveness of the clay. In conventional commercial processing for producing beneficiated kaolin clay, the clay is first blunged in water with a dispersing agent to form a clay-in-water suspension or slurry. After degritting and fractionation on a centrifuge to recover a desired particle size fraction, the fine particle fraction is typically diluted with water to 15% to 40% by weight solids content. This suspension is then typically treated with a bleaching compound containing a reducing agent, such as the dithionite ion, to reduce ferric ions in the clay to the ferrous state. After allowing the clay fraction to react with a reducing agent for a period of time, the clay fraction is filtered, rinsed and then dried for shipment. Generally, for commercial purposes, the clay slurry must be shipped at a solids content of at least 65% by weight, and for most applications at about 70% solids by weight.

Figure 1:
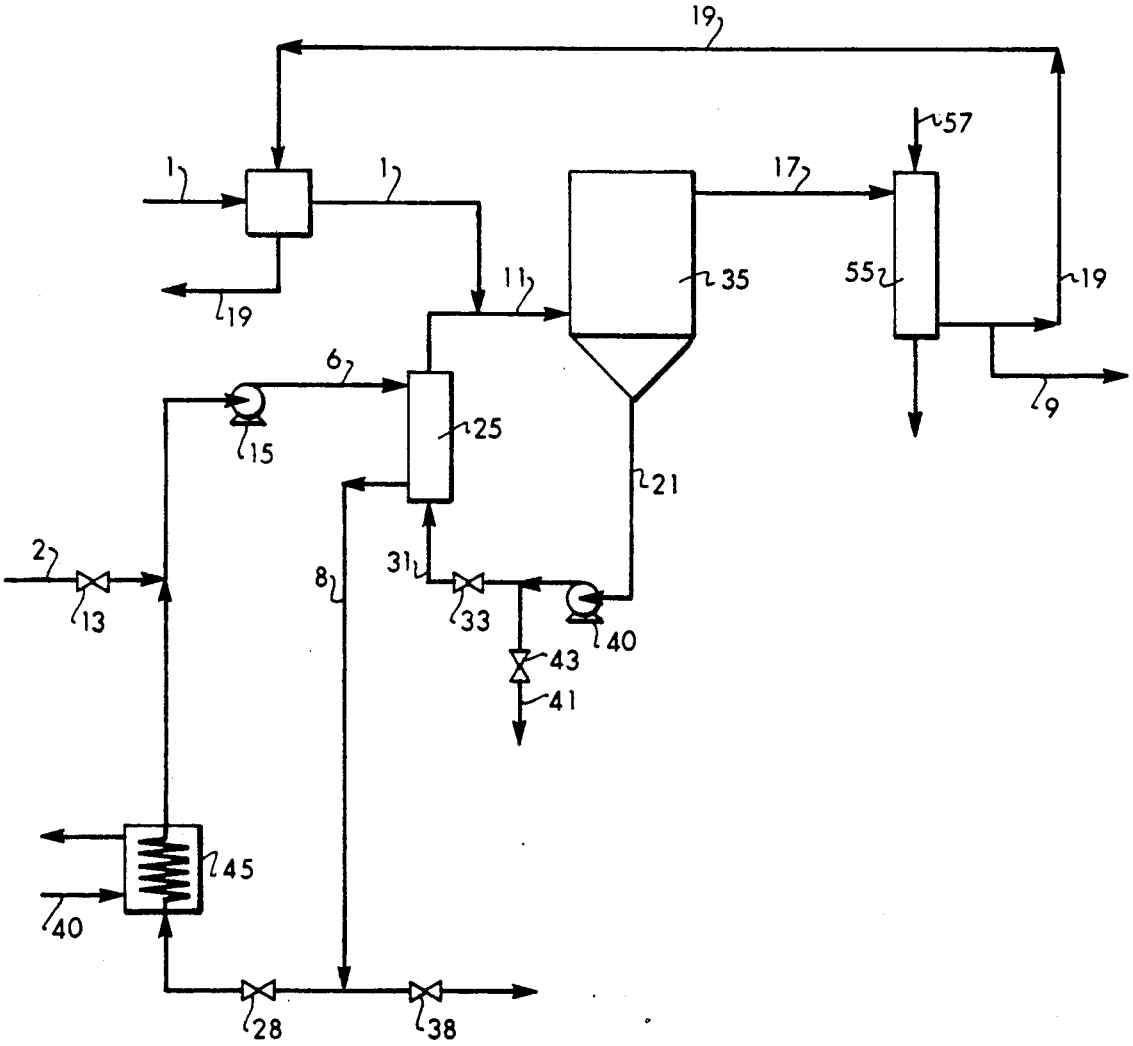
FIG. 1 is a schematic view of an embodiment of the process of the present invention using a single non-contact evaporative heat exchanger.

In the single evaporative heat exchanger embodiment of the present invention shown in FIG. 1, a beneficiated clay slurry 1 to be concentrated to a higher solids content, such as but not limited to an already partially dried beneficiated clay slurry typically having a solids content in the range of about 50% to about 60% by weight which is to be further dewatered to concentrate the solids therein to a level suitable for shipment, typically at least 65% solids by weight, is passed through a single non-contact type evaporative heat exchanger 25 in indirect contact with a heating liquid 6 wherein a portion of the water contained in the aqueous clay slurry is evaporated. The clay slurry leaving the evaporative heat exchanger 25 passes to a separating vessel 35 wherein the vapor evaporated from the clay slurry in the evaporative heat exchanger 25 is separated from the clay slurry. The clay slurry 21 leaving the separating vessel 35 has a higher solids content than the clay slurry feed 1 entering the system due to the evaporation of water therefrom as the clay slurry passes in heat exchange relationship with the heating liquid 6. It is to be understood that the separating vessel 35 may be housed independently of the heat exchanger vessel 25 as shown in the drawing or, if desired, formed integrally with the heat exchanger in a single vessel.

In order to effect evaporation of water from the clay slurry heated in the indirect heat exchanger 25, the separating vessel 35 is maintained under a vacuum, preferably at an absolute pressure of about 2 inches mercury at which absolute pressure evaporation will occur at a temperature of about 100° F. Accordingly, when the heated clay slurry 11 is discharged from the heat exchanger 25 into the separating vessel 35, water vapor is released from the heated clay slurry 11 thereby concentrating the solids in the clay slurry such that the clay slurry 21 leaving the separating vessel 35 has a higher solids content than the clay slurry 1 being supplied to the system. Most advantageously, the low solids clay slurry 1 entering the system is mixed with the heated clay slurry 11 passing from the heat exchanger 25 to the separating vessel 35. However, the incoming low solids clay slurry 1 may be introduced into the system at other locations without departing from the spirit and scopy of the present invention.

Preferably, a clay slurry recirculation loop is provided for recirculating at least a portion 31 of the higher solids clay slurry 21 back through the heat exchanger 25 and the separator vessel 35 to permit further evaporation of water from the clay slurry. The recirculation loop provides a clay slurry flow passage from the outlet of the discharge of the separating vessel 35 to the clay feed inlet of the heat exchanger 25 and includes a slurry circulation pump 40 disposed in the recirculation loop therebetween for pumping the clay slurry through the circuit. Valves 33 and 43 are provided in the discharge line from the separating vessel 35 so that the flow of the higher solids clay slurry 21 discharged from the separating vessel 35 may be selectively proportioned between the heat exchanger feed flow 31 and product flow 41 streams. The flow of clay slurry 21 passing through the recirculation loop is mixed with incoming lower solids feed slurry 1 whereby the solids content of the resultant clay slurry mixture being passed through the heat exchanger 24 and separator vessel 35 is initially increased which in turn results in the clay slurry 21 having a still higher content. By controlling the ratio of the heat exchanger feed flow 31 to the slurry feed flow 1, a higher solids product may be attained under steady state conditions using a single heat exchanger arrangement than would be attainable under steady state conditions without recirculation. Operational steady state recirculation ratios in commercial practice would typically range from about 10 to about 30, with the recirculated ratio being the volume flow of recirculating slurry to the volume flow of feed slurry.

The heating liquid 6 is preferably circulated under forced circulation via pump means 15 through heat exchanger 25 in indirect heat exchange relationship with the clay slurry 31. As presently contemplated, it is preferred that the heat exchanger 25 comprise a plate and frame type heat exchanger wherein the clay slurry 31 and the heating liquid 6 are passed through alternate flow passages formed between spaced heat transfer plates within the heat exchanger frame. However, it is to be understood that the present invention is not limited in scope by or to the particular type of indirect heat exchanger employed.

After having passed through the heat exchanger 25 in indirect heat exchanger relationship with the clay slurry 31, the cool heating liquid 8 may be recirculated after reheating by forced circulation pump means 15 by venting valve 28 and closing valve 38. Preferably, the cool heating fluid 8 is reheated by transferring waste heat from elsewhere in the kaolin processing plant to reheat the heating fluid to the desired temperature. In most kaolin plants, a particularly advantageous source of such waste heat would be the hot exhaust gas from a calciner or a spray dryer. For example, the recirculation heating fluid may be through an indirect heat exchanger 45 in indirect heat exchange relationship with a heating fluid, such as hot exhaust gas 40, to recover waste heat contained therein.

Alternatively, the cool heating fluid 8 may be passed to waste or directed for use elsewhere in the kaolin processing plant by opening valve 33 and closing the recirculation line valve 23. In such case, valve 13 would be opened to supply a continuous flow of heating fluid 2 from a source elsewhere in the kaolin processing plant. Again, the heating fluid 2 is preferably heated via recovered waste heat by passing the heating fluid 2 in indirect heat exchange relationship with a heating fluid, such as hot exhaust gas.

In either case, it may be advantageous to recover the vapor 17 evaporated from the clay slurry 1 in the heat exchanger 25 and separated from the clay slurry in the separating vessel 35. To this end, the generated vapor 17 is passed from the separating vessel 35 through condenser 55 in heat exchange relationship with a cooling fluid 57 to condense the vapor 17 to produce a condensate 19 comprises condensed water vapor previously evaporated from the clay slurry. Any non-condensible gases 9, typically leakage air and some carbon dioxide, present in the condensate discharging from the condenser 55 are vented to vacuum. The condensed water vapor 19 may be utilized elsewhere in the clay processing or heated with waste heat, such as hereinbefore described with respect to the circulating heating fluid, and utilized to form at least a part of the heating fluid 6 to be passed in indirect heat exchange relationship with the clay slurry 1 passing through the heat exchanger 25.

If the condensate 19 is sufficiently warm, that is if the condensate 19 is formed by merely cooling the vapor 17 in the condenser 55 sufficiently to cause phase transformation from a vapor to liquid but not sufficiently to chill the condensed liquid, the condensate 19 may be used as a heating medium by passing the condensate 19 in heat exchange relationship with the clay slurry feed 1 thereby preheating the clay slurry 1 prior to passing it through heat exchanger 25 and thereby recovering as heat a portion of the energy expended in evaporating the water from the clay. Further heat may be recovered from the vapor 17 when the condenser 55 comprises a direct contact type condenser, such as a spray tower wherein the vapor 17 would be contacted by a spray of cooling liquid to cause the condensation of the vapor. When such a direct contact condenser is used, the condensate 19 would comprise not only the condensed vapor but also heated cooling liquid, whereby the heat of condensation released by the vapor 17 as it condenses is recovered directly in the condensate 19. A thorough discussion of the use of a spray tower to condense water vapor in a gaseous stream and the utilization of the condensate in clay processing to recover the heat contained therein is presented in commonly-assigned U.S. Pat. No. 4,642,904 of James M. Smith, Jr.

By way of illustration, it is contemplated that approximately 38.96 tons/hour of clay slurry having a solids content of 72% could be produced using a single indirect evaporative heat exchanger arrangement, such as shown in FIG. 1, to carry out the process of the present invention by passing approximately 46.76 tons/hour of 60% solids clay slurry feed preheated to 100° F. through an indirect heat exchanger having an effective heat transfer surface area of about 7,127 square feet in indirect heat exchange relationship with about 810 gallons per minute of hot water to heat the clay slurry to a temperature of 110° F. and then venting the heated slurry to a separating vessel maintained under vacuum at an absolute pressure of 1.932 inches of mercury.

Lower heating fluid temperature may be utilized if the effective heat transfer surface area of the heat exchanger 25 is increased. For example, it is contemplated that approximately 38.96 tons/hour of clay slurry having a solids content of 72% could be produced using a single indirect evaporative heat exchanger arrangement, such as shown in FIG. 1, to carry out the process of the present invention by passing approximately 46.76 tons/hour of 60% solids clay slurry feed preheated to 100° F. through an indirect heat exchanger having an effective heat transfer surface area of about 14,254 square feet in indirect heat exchange relationship with about 1,290 gallons per minute of hot water to heat the clay slurry to a temperature of 110° F. and then venting the heated slurry to a separating vessel maintained under vacuum at an absolute pressure of 1.932 inches of mercury.

In the multiple evaporative heat exchanger embodiment of the present invention, a plurality of indirect evaporative heat exchangers are disposed in series with the downstream most heat exchanger with respect to clay slurry flow being driven by hot liquid, while the remainder of the heat exchangers are driven by hot vapor previously evaporated from the clay in the next upstream evaporative heat exchanger. As in the case of the single evaporative heat exchanger previously described herein with reference to FIG. 1, each evaporative heat exchanger comprises a heat exchanger section wherein the clay slurry is passed in indirect heat exchange relationship with a heating medium and a separator section wherein the heated clay slurry is received from the heat exchanger section and the water vapor is released therefrom.

Figure 2:
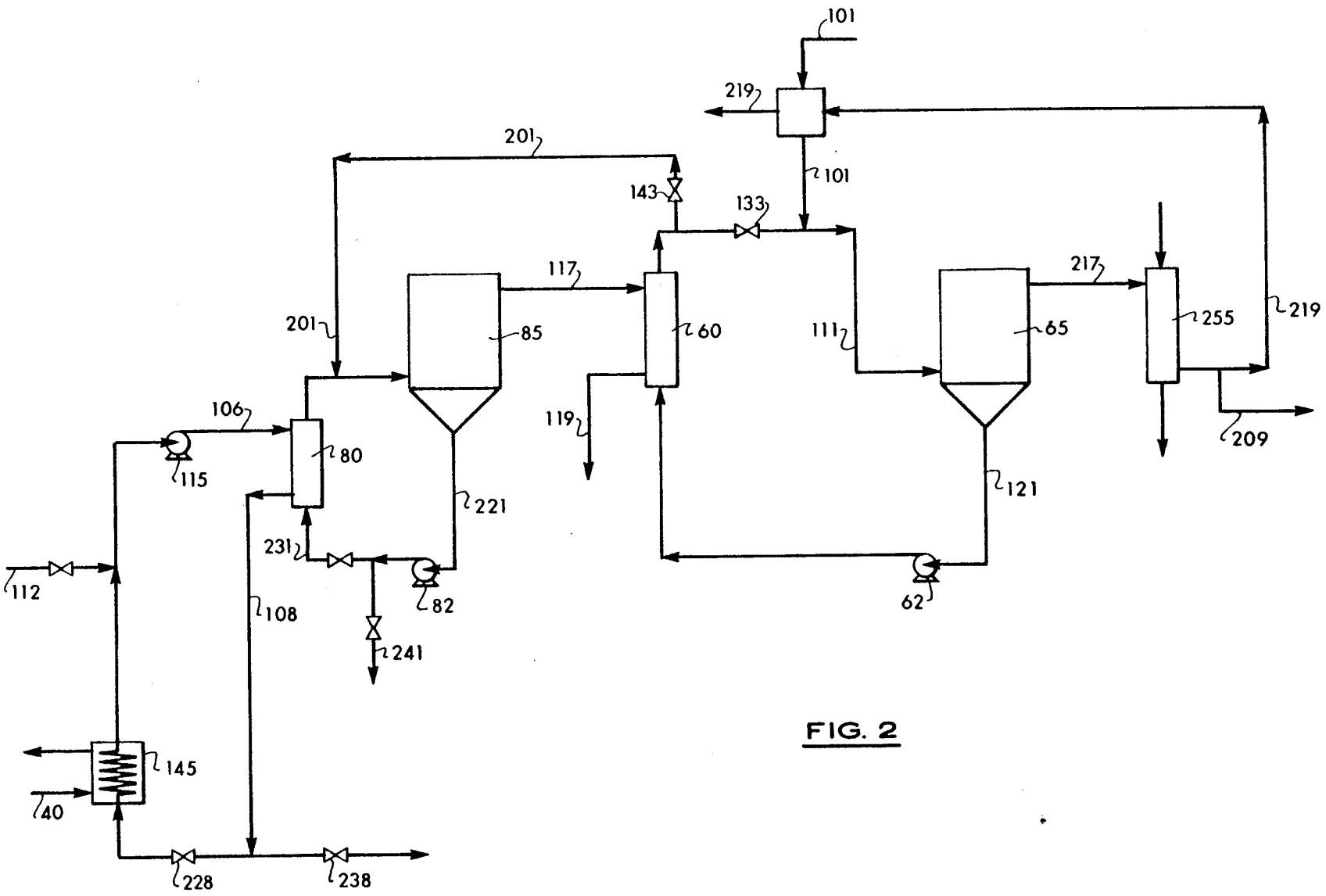
FIG. 2 is a schematic view of an embodiment of the process of the present invention using two non-contact evaporative heat exchangers disposed in series relationship with respect to clay slurry flow.

An example of such a multiple evaporative heat exchanger arrangement is the series arrangement of two evaporative heat exchanger/separating vessel assemblies 60,65 and 80,85 illustrated in FIG. 2. In such an arrangement, the beneficiated kaolin clay slurry to be concentrated to a higher solids content, such as but not limited to an already partially dried beneficiated clay slurry typically having a solids content in the range of about 50% to about 60 by weight which is to be further dewatered to concentrate the solids therein to a level suitable for shipment, typically at least 65% solids by weight, is passed in series flow relationship through a first non-contact type evaporative heat exchanger in indirect contact with a first heating medium wherein a portion of the water contained in the aqueous clay slurry is evaporated.

The aqueous clay slurry is then passed through a second non-contact type evaporative heat exchanger in indirect contact with a second heating medium wherein additional water contained in the aqueous clay slurry is evaporated to further concentrate the aqueous clay slurry to a higher solids content.

In the series flow, multiple evaporative heat exchanger arrangement shown in FIG. 2, a first heat exchanger/separating vessel assembly 60,65 and a second heat exchanger/separating vessel assembly 80,85 are arranged in series flow arrangement with respect to clay slurry flow. The aqueous kaolin clay slurry is first passed through the first exchanger/separating vessel assembly 60,65 wherein it is passed in indirect heat exchange relationship with a heating medium, which constitutes water vapor evaporated from the clay slurry as it passes thereafter through the second heat exchanger/separating vessel assembly 80,85, wherein the aqueous clay slurry is passed in indirect heat exchange relationship with a hot heating fluid, preferably hot water having a temperature ranging from about 120° F. to about 200° F.

Each of the evaporative heat exchanger/separating vessel assemblies 60,65 and 80,85 in the multiple evaporator arrangement comprise a basic single evaporator of the type shown in FIG. 1 and previously described herein. That is, each of the evaporator assemblies 60,65 and 80,85 comprise, respectively, an indirect heat exchanger 60,80 and a separating vessel 65,85 maintained at a vacuum and interconnected its respective heat exchanger via a clay slurry flow recirculation loop.

In operation, the clay slurry feed 1 to be concentrated is mixed with the clay slurry 111 leaving the first heat exchanger 60 and passing to the separating vessel 65 which is maintained under a vacuum, preferably at an absolute pressure of about 2 inches mercury at which absolute pressure evaporation will occur at a temperature of about 100° F. When the heated clay slurry 111 is discharged from the heat exchanger 60 into the vacuum chamber of the separating vessel 65, water vapor is released therefrom thereby concentrating the solids in the clay slurry such that the clay slurry 121 leaving the separating vessel 65 has a higher solids content than the clay slurry 101 being supplied to the system.

The clay slurry 121 leaving the separating vessel 65 is preferably recirculated via slurry pump 62 back through the heat exchanger 60 to reheat the clay slurry. A first portion 111 of the heated clay slurry is recirculated back through the separating vessel 65 to further evaporate water therefrom, while a second portion 201 of the heated aqueous clay slurry leaving the first heat exchanger 60 is passed to the separating vessel 85 of the second evaporative heat exchanger/separating vessel assembly. Valves 133 and 143 are provided in the discharge line from the indirect heat exchanger 60 may be selectively proportioned between the separating vessel 65 and the separating vessel 85 to optimize the process of concentrating the clay slurry to obtain a higher solids content in the most energy efficient manner.

As in a single evaporator arrangement as previously discussed hereinbefore, it may be advantageous to recover the vapor 117 separated from the clay slurry in the separating vessel 65. To this end, the generated vapor 117 is passed from the separating vessel 65 through condenser 155 in heat exchange relationship with a cooling fluid 157 to condense the vapor 117 to produce a condensate 119 comprising condensed water vapor previously evaporated from the clay slurry. Any non-condensible gases 9, typically leakage air and some carbon dioxide, present in the condensate discharging from the condenser 155 are vented to vacuum.

The heated aqueous clay slurry 201 passing from the first heat exchanger 60 is mixed with the flow of heated clay slurry 211 passing from the second heat exchanger 80 and the mixture thereof introduced into the vacuum chamber the second separating vessel 85 wherein the water is evaporated from the heated clay slurry and separated as a heated vapor 117 thereby producing a discharge clay slurry 221 having a higher solids content than the clay slurry mixture supplied to the separating vessel 85.

Preferably, a clay slurry recirculation loop is provided for recirculating at least a portion 231 of the higher solids clay slurry 221 back through the heat exchanger 80 and the separator vessel 85 to permit further evaporation of water from the clay slurry. The recirculation loop provides a clay slurry flow passage from the outlet of the discharge of the separating vessel 85 to the clay feed inlet of the heat exchanger 80 and includes a slurry circulation pump 82 disposed in the recirculation loop therebetween for pumping the clay slurry through the circuit. Valves 233 and 243 are provided in the discharge line from the separating vessel 85 so that the flow of the higher solids clay slurry 221 discharged from the separating vessel 85 may be selectively proportioned between the heat exchanger feed flow 231 and product flow 241 streams. By controlling the ratio of the heat exchanger feed flow 231 to the slurry feed flow 101 and 201, a higher solids product may be attained under steady state conditions using a single heat exchanger arrangement than would be attainable under steady state conditions without recirculation. Operational steady state recirculation ratios in commercial practice would typically range from 10 to 30, with the recirculated ratio being the volume flow of recirculating slurry to the volume flow of feed slurry.

The heating liquid 106 preferably comprises hot water having a temperature in the range of 160° F. to 200° F. Although such hot water 112 may be available under continuous flow conditions from another source in the plant, it is preferable to reheat the cooled heating liquid 108 discharged from the indirect heat exchanger 80 and recirculate the reheated liquid via a circulation pump 115 back through the heat exchanger 80 as the heating liquid in heat exchange relationship with the clay slurry. As noted previously in the discussion of the single evaporator arrangement, the cool heating fluid 108 may be reheated by transferring waste heat from elsewhere in the kaolin processing plant to reheat the heating fluid to the desired temperature. In most kaolin plants, a particularly advantageous source of such waste heat would be the hot exhaust gas from a calciner or a spray dryer. For example, the recirculating fluid may be passed through an indirect heat exchanger 145 in indirect heat exchange relationship with a stream of hot exhaust gas 40.

As mentioned previously, the hot vapor 117 separated from the heated clay slurry in the second separating vessel 85 serves as the heating medium to drive the first heat exchanger 60. The hot vapor 117 is passed from the second separating vessel 85 through the first heat exchanger 60 in indirect heat exchange relationship with the aqueous clay slurry 121 to produce the heated clay slurry 111. The hot vapor 117 is preferably condensed in the heat exchange process thereby recovering the heat of vaporization in addition to sensible heat contained in the vapor 117.

If the condensates 119 and 219 is sufficiently warm, that is if the condensate is formed by merely cooling the vapor sufficiently to cause phase transformation from a vapor to liquid but not sufficiently to chill the condensed liquid, the condensate 119, and/or 219 may be used as a heating medium by passing the condensate in heat exchange relationship with the clay slurry feed 101 thereby preheating the clay slurry 101 prior to passing it through the first heat exchanger/separating vessel assembly and thereby recovering as heat a portion of the energy expended in evaporating the water from the clay. Further heat may be recovered from the vapor 217 when the condenser 255 comprises a direct contact type condenser, such as a spray tower wherein the vapor 217 would be contacted by a spray of cooling liquid to cause the condensation of the vapor. When such a direct contact condenser is used, the condensate 219 would comprise not only the condensed vapor but also heated cooling liquid, whereby the heat of condensation released by the vapor 217 as it condenses is recovered directly in the condensate 219. A thorough discussion of the use of a spray tower to condense water vapor in a gaseous stream and the utilization of the condensate in clay processing to recover the heat contained therein is presented in commonly-assigned U.S. Pat. No. 4,642,904 of James M. Smith, Jr.

By way of illustration, it is contemplated that at steady state operation approximately 38.96 tons/hour of clay slurry having a solids content of 72% could be produced using a double effect indirect evaporative heat exchanger arrangement, such as shown in FIG. 2, to carry out the process of the present invention by passing approximately 46.63 tons/hour of 60% solids clay slurry feed preheated to 100° F. through a first indirect heat exchanger 60 having an effective heat transfer surface area of about 1,795 square feet in indirect heat exchange relationship with about 7887 pounds per hour of water vapor having a temperature of 140° F. and produced in the second separating vessel 85. The heated clay slurry discharging from the first heat exchanger 60 would be passed to the second separating vessel 85 at a solids content of 65.4 and thence through the second heat exchanger 80 in indirect heat exchange relationship with 650 gallons per minute of 180° F. water. In this example, the first separating vessel 65 is maintained under vacuum at an absolute pressure of about 1.932 inches mercury to promote evaporation at a temperature of about 100° F., while the second separating vessel 85 is maintained under vacuum at an absolute pressure of about 5.878 inches mercury to promote evaporation at a temperature of about 140° F.

I claim:

1. A method for concentrating solids in an aqueous clay slurry by evaporating water therefrom comprising:

a. passing aqueous kaolin clay slurry in indirect heat exchange relationship with a heating liquid so as to heat the clay slurry without contacting the clay slurry with the heating medium; and b. passing the thus heated aqueous clay slurry into a first chamber maintained at a vacuum whereby at least a portion of the water in the heated aqueous clay slurry will evaporate therefrom to form water vapor thereby concentrating solids in the aqueous clay slurry to produce a higher solids content aqueous clay slurry; and c. selectively dividing the higher solids content aqueous clay slurry produced in the first chamber into a first portion and a second portion, said first portion being mixed with incoming aqueous kaolin clay slurry and recirculated in indirect heat exchange relationship with the heating liquid and said second portion being discharged as product.

2. A method for concentrating solids in an aqueous clay slurry by evaporating water therefrom as recited in claim 1 wherein the aqueous clay slurry passed in indirect heat exchange relationship with the heating liquid to heat the kaolin clay slurry to a temperature of about 110° F.

3. A method for concentrating solids in an aqueous clay slurry be evaporating water therefrom as recited in claim 2 wherein the heated aqueous clay slurry is passed into a vacuum chamber maintained at a pressure of about two inches of mercury absolute.

4. A method for concentrating solids in an aqueous clay slurry by evaporating water therefrom as recited in claim 2 wherein the heating liquid comprises hot water having a temperature ranging from about 120° F. to about 200° F.

5. A method for concentrating solids in an aqueous clay slurry by evaporating water therefrom as recited in claim 4 further comprising heating the water comprising the heating liquid to a temperature in the range of about 120° F. to 200° F. by passing the water in heat exchange relationship with a hot gas to recover waste heat from the hot gas.

6. A method for concentrating solids in an aqueous clay slurry by evaporating water therefrom as recited in claim 1 further comprising selectively proportioning the higher solids content aqueous clay slurry produced in the first chamber into said first portion and said second portion such that the ratio of the volume flow of said first portion to the volume flow of the lower solids content aqueous clay slurry feed to be concentrated ranges from about 10 to about 30.

7. A method for concentrating solids in an aqueous clay slurry by evaporating water therefrom comprising:

passing a lower solids content aqueous clay slurry in indirect heat exchange relationship with a first heating medium so as to heat the clay slurry without contacting the clay slurry with the first heating medium, and thereafter passing the heated aqueous clay slurry in indirect heat exchange relationship with a second heating medium so as to further heat the clay slurry without contacting the clay slurry with the second heating medium, and thence passing the further heated aqueous slurry into a first chamber maintained at a vacuum whereby at least a portion of the water in the aqueous clay slurry will evaporate therefrom to form water vapor thereby concentrating solids in the aqueous clay slurry to produce a higher solids content aqueous clay slurry, the second heating medium comprising a hot liquid and the first heating medium comprising hot water vapor previously released from the aqueous clay.

8. A method for concentrating solids in an aqueous clay slurry by evaporating water therefrom as recited in claim 7 wherein the hot liquid comprising the second heating medium comprises water having a temperature in the range of about 160° F. to about 200° F.

9. A method for concentrating solids in an aqueous clay slurry by evaporating water therefrom as recited in claim 8 wherein the first heating medium comprises water vapor having a temperature in the range of about 120° F. to about 160° F.

10. A method for concentrating solids in an aqueous clay slurry by evaporating water therefrom as recited in claim 7 wherein the first vacuum chamber is maintained at a pressure of about six inches of mercury absolute.

11. A method for concentrating solids in an aqueous clay slurry by evaporating water therefrom as recited in claim 7 further comprising passing the heated aqueous clay slurry having been passed in indirect heat exchange relationship with the first heating medium into a second chamber maintained at a vacuum whereby a portion of the water in the heated aqueous clay slurry will evaporate therefrom to form water vapor thereby partially dewatering the heated aqueous clay slurry prior to passing the heated partially dewatered aqueous clay slurry in indirect heat exchange relationship with the second heating medium.

12. A method for concentrating solids in an aqueous clay slurry by evaporating water therefrom as recited in claim 11 wherein the first vacuum chamber is maintained at a pressure of about six inches of mercury absolute and the second vacuum chamber is maintained at a pressure of about two inches of mercury absolute.

13. A method for concentrating solids in an aqueous clay slurry by evaporating water therefrom as recited in claim 11 wherein the hot liquid comprising the second heating medium comprises water having a temperature in the range of about 60° F. to about 200° F.

14. A method for concentrating solids in an aqueous clay slurry by evaporating water therefrom as recited in claim 13 wherein the first heating medium comprises water vapor having a temperature in the range of about 120° F. to about 160° F.

15. A method for concentrating solids in an aqueous clay slurry by evaporating water therefrom as recited in claim 13 further comprising heating the water comprising the second heating medium to a temperature in the range of about 160° F. to 200° F. by passing the water in heat exchange relationship with a hot gas to recover waste heat from the hot gas.

16. A method for concentrating solids in an aqueous clay slurry by evaporating water therefrom as recited in claim 11 further comprising selectively dividing the higher solids content aqueous clay slurry produced in the first chamber into a first portion and a second portion, said first portion being recirculated in indirect heat exchange relationship with the heating medium and said second portion being discharged as product.

17. A method for concentrating solids in an aqueous clay slurry by evaporating water therefrom as recited in claim 16 further comprising selectively proportioning the higher solids content aqueous clay slurry produced in the first chamber into said first portion and said second portion such that the ratio of the volume flow of said first portion to the volume flow of the lower solids content aqueous clay slurry feed to be concentrated ranges from about 10 to about 30.

18. An apparatus for concentrating solids in an aqueous slurry by evaporating water therefrom by passing the aqueous slurry in indirect heat exchange relationship with a heating medium whereby water is evaporated from the aqueous slurry with the heating medium, said apparatus comprising:

a. first heat exchange means for passing the aqueous slurry in indirect heat exchange relationship with a hot heating liquid whereby the aqueous slurry is heated and the heating liquid cooled;

b. first chamber means operatively associated with said first heat exchange means for receiving at least a portion of the heated aqueous slurry having passed through the first heat exchange means, said first chamber means being maintained at sufficient vacuum to cause water to evaporate from the heated aqueous slurry into said first chamber means as a vapor;

c. first recirculation means operatively innerconnecting said first heat exchange means and said first chamber means in slurry flow communication for circulating at least portion of the aqueous slurry in circulatory flow through said first heat exchange means and through said first chamber means;

d. first valve means operatively associated with said first recirculation means for selectively proportioning the aqueous clay slurry into a first portion for passing in circulatory flow through said first heat exchange means and through said first chamber means and a second portion for passing from said apparatus as a higher solids aqueous slurry product;

e. second heat exchange means for passing the aqueous slurry in indirect heat exchange relationship with a hot heating vapor received from said first chamber means whereby the aqueous slurry is heated and the heating liquid cooled;

f. second chamber means operatively associated with said second heat exchange means for receiving at least a portion of the heated aqueous slurry having passed through the second heat exchange means, said second chamber means being maintained at sufficient vacuum to cause water to evaporate from the heated aqueous slurry into said second chamber means as a vapor;

g. second recirculation means operatively innerconnecting said second heat exchange means and said second chamber means in slurry flow communication for circulating at least portion of the aqueous slurry in second circulatory flow through said second heat exchange means and through said second chamber means; and h. second valve means operatively associated with said second recirculation means for selectively proportioning the aqueous clay slurry into a first portion for passing in circulatory flow through said second heat exchange means and through said second chamber means and a second portion for directing to said first exchange means for passing in indirect heat exchange therein with the hot heating liquid to further heat the aqueous clay slurry.

19. An apparatus as recited in claim 18 further comprising third heat exchange means for heating the heating liquid supplied to said first heat exchange means by passing the heating liquid in heat exchange relationship with a hot gas to recover waste heat from the hot gas.

* * * * *